United States Patent [19]

Sze

[11] 4,208,191

[45] Jun. 17, 1980

[54] PRODUCTION OF PIPELINE GAS FROM COAL

[75] Inventor: Morgan C. Sze, Upper Montclair, N.J.

[73] Assignee: The Lummus Company, Bloomfield, N.J.

[21] Appl. No.: 910,823

[22] Filed: May 30, 1978

[51] Int. Cl.[2] ..... C10J 3/00

[52] U.S. Cl. ..... 48/210; 48/197 R; 260/449.6 M; 260/449 S

[58] Field of Search ..... 48/197 R, 210, 215; 260/449 M, 449.6 M, 449 S

[56] References Cited

U.S. PATENT DOCUMENTS

| | | | |
|---|---|---|---|
| 1,746,464 | 2/1930 | Fischer et al. | 260/449.6 R |
| 2,207,581 | 7/1940 | Duftschmid et al. | 260/449.6 F |
| 2,301,687 | 11/1942 | Durschner | 260/449.6 R |
| 2,436,957 | 3/1948 | Eastman | 260/449.6 R |
| 2,527,154 | 10/1950 | Scharmann | 260/449.6 R |
| 2,570,615 | 9/1951 | Watkins | 260/667 |
| 2,665,288 | 1/1954 | Odell | 260/449 M |
| 2,694,623 | 11/1954 | Wehty et al. | 48/197 R |
| 2,694,624 | 11/1954 | Sweetser | 48/197 R |
| 2,717,259 | 9/1955 | Davis et al. | 260/449.6 R |
| 2,833,803 | 5/1958 | Frye | 260/449.6 R |
| 2,840,462 | 6/1958 | Gorin | 48/197 R |
| 2,960,518 | 11/1960 | Peters | 260/449.6 R |
| 2,963,348 | 12/1960 | Sellers | 48/197 R |
| 2,973,384 | 2/1961 | Hayashi et al. | 260/449.6 R |
| 3,031,287 | 4/1962 | Benson et al. | 48/197 R |
| 3,156,657 | 11/1964 | Pinder et al. | 252/440 |
| 3,429,679 | 2/1969 | Friedman et al. | 48/197 R |
| 3,511,624 | 5/1970 | Humphries et al. | 48/197 R |
| 3,548,024 | 12/1970 | Kniel | 260/683 |
| 3,854,895 | 12/1974 | Muller | 260/449 M |
| 3,870,738 | 3/1975 | Yamamoto et al. | 260/449 M |
| 3,917,467 | 11/1975 | Toida et al. | 260/449 M |
| 3,922,148 | 11/1975 | Child | 48/197 R |
| 4,005,996 | 2/1977 | Hausberger et al. | 48/197 RR |

FOREIGN PATENT DOCUMENTS

| | | | |
|---|---|---|---|
| 465157 | 4/1937 | United Kingdom | 260/449 M |

OTHER PUBLICATIONS

Woodward, "Catalyst Available for High-temperature Methanation", Hydrocarbon Processing, pp. 136–138, Jan. 1977.

*Primary Examiner*—S. Leon Bashore
*Assistant Examiner*—George C. Yeung
*Attorney, Agent, or Firm*—Louis E. Marn; Elliot M. Olstein

[57] ABSTRACT

Acid gases are removed from a coal gasification gas, followed by contacting the gas with a reduced iron catalyst at conditions selected to primarily produce methane, and some olefins together with carbon dioxide as byproduct. After separation of carbon dioxide byproduct, the gas is contacted with a nickel catalyst under methanation conditions to produce additional methane and convert olefins to alkanes to thereby produce a pipeline gas having an increased heating value.

15 Claims, 1 Drawing Figure

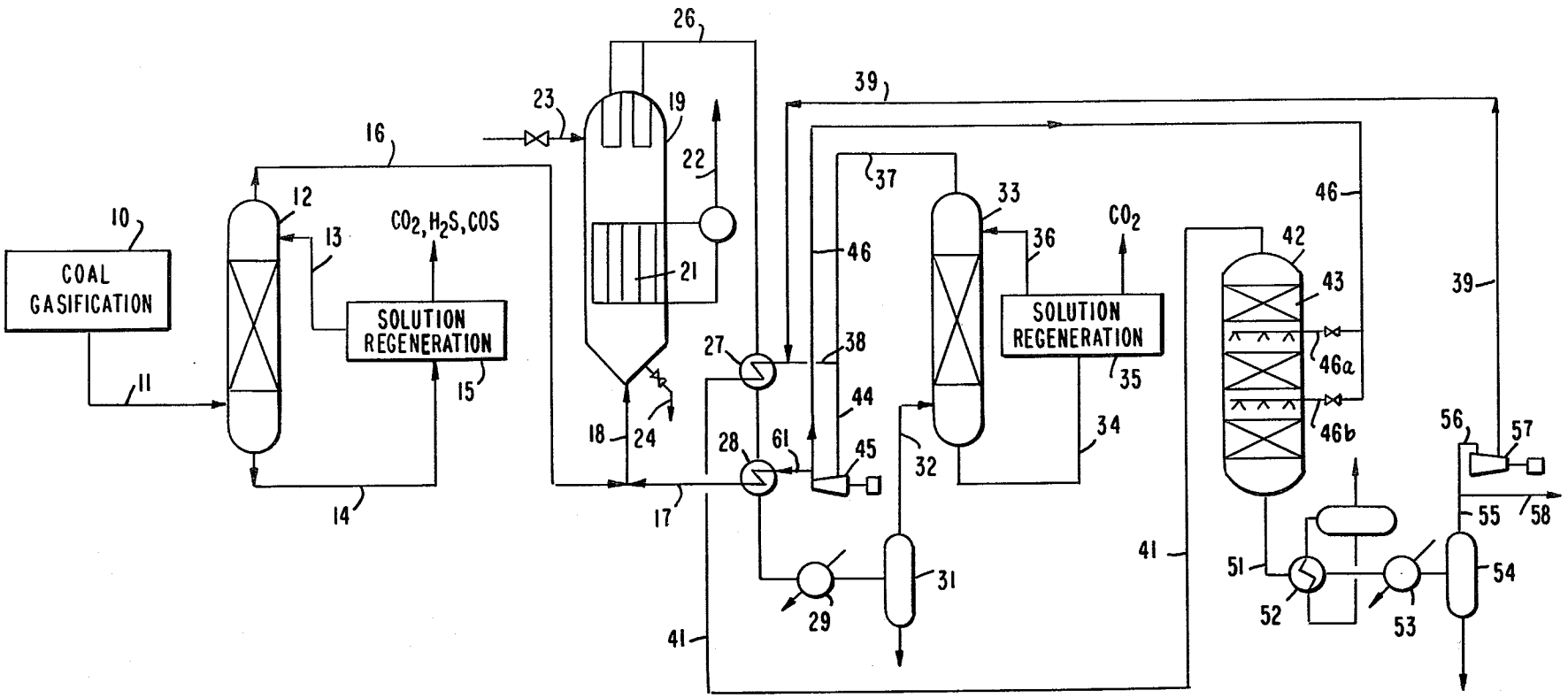
COAL GASIFICATION
SOLUTION REGENERATION
$CO_2, H_2S, COS$
SOLUTION REGENERATION
$CO_2$

PRODUCTION OF PIPELINE GAS FROM COAL

This invention relates to the production of a pipeline gas, and more particularly to a new and improved process for producing a pipeline gas from a coal gasification effluent.

In the manufacture of pipeline gas from coal, the main processing steps are:

(1) gasification of coal under pressure;
(2) removal of acid gases;
(3) carbon monoxide shift to adjust the proper hydrogen to carbon monixide ratio for methanation and removal of carbon dioxide; and
(4) methanation of the carbon monoxide to methane in the presence of a nickel catalyst.

In such processes, the methanation step is difficult and causes certain problems. In addition, the pipeline gas produced by such a process has a limited heating value, with such heating value generally being, at the maximum, no more than 950–960 BTU per SCF.

The present invention is directed to a new and improved process for producing pipeline gas from coal.

In accordance with the present invention, coal is gasified to a gas containing carbon monoxide, hydrogen, gaseous sulphur compounds, methane and carbon dioxide. Gaseous sulphur compounds and carbon dioxide are removed from the gas in an acid gas removal system, followed by contacting of the gas with a reduced iron catalyst at conditions to produce primarly methane, and small amounts of olefins, followed by separation of carbon dioxide byproduct and methanation with a nickel catalyst to produce additional methane and convert olefins to alkanes and thereby produce a pipeline gas having increased heating value.

The gasification of coal to produce the gasification effluent is a procedure well known in the art, and forms no part of the present invention. As known in the art, such gasification is effected with oxygen and steam, and in view of the fact that such procedures are well known in the art, no details in this respect are deemed necessary for a complete understanding of the present invention.

Similarly, the separation of acid gases from the coal gasification effluent is a procedure well known in the art, and such procedures are employed in the process of the present invention. As known in the art, gaseous sulphur compounds; in particular, COS and $H_2S$, as well as carbon dioxide, may be effectively separated from the gas by contact with a suitable acid gas absorption solution, such as an alkali carbonate or an alcohol amine. No details with respect to such acid gas separation are deemed necessary for a complete understanding of the present invention.

Subsequent to the acid gas removal, the coal gasification gas contains small amounts of gaseous sulphur compounds, with such gaseous sulphur compounds being present in an amount of less than 3–5 parts per million of sulphur. In accordance with the present invention, the gas which contains hydrogen and carbon monoxide, as well as trace amounts of gaseous sulphur compounds, is subjected to a Fischer-Tropsch reaction at high temperature in order to produce mainly methane, and small amounts of olefins, with such reaction being effected in the presence of a reduced iron catalyst, which may or may not be promoted with a suitable promoter, such as copper, potassium carbonate or sodium carbonate. The reaction is effected at a temperature in the order of from about 375°–555° C., preferably 425°–475° C., and at a pressure of from 20–100 atms., preferably 30–75 atms. In effecting the reaction, the hydrogen to carbon monoxide mole ratio is generally in the order of from about 0.8:1 to about 2.5:1, preferably from about 0.9:1 to 1.8:1.

The reaction is preferably effected in a fluidized bed reactor, which is cooled by a suitable heat transfer fluid, such as vaporizing DOWTHERM. The heat transfer fluid may then be used to generate high pressure steam.

It has been bound that the use of a reduced iron catalyst, at the specified conditions, offers the advantage that the carbon monoxide is mainly converted to methane, and offers the further advantage that any trace amounts of sulphur which are present in the gas combine with the iron catalyst to form iron sulfide, which can be periodically removed from the reactor. Carbon dioxide is produced as a byproduct in the reaction, and is subsequently removed from the gas.

The gas, which is now free of sulphur and carbon dioxide, is then methanated in the presence of a nickel catalyst. In general, the gas contains less than 5% carbon monoxide. The methanation is effected at a temperature in the order of from 230° C. to about 600° C., preferably from about 260° C. to about 480° C., and at a pressure in the order of from 10 atms. to about 70 atms. The temperature of the methanation can be controlled by use of a quench gas, and/or by recycling some of the methanation product gas. In the methanation, carbon monoxide is methanated to methane, and olefins present in the gas, are hydrogenated to alkanes.

After cooling, the methanation effluent may be employed as a pipeline gas. Such pipeline gas generally has a heating value of at least 1000 BTU per SCF, and generally in the order of from about 1025 to about 1100 BTU per SCF.

The invention will be further described with respect to an embodiment thereof, illustrated in the accompanying drawing wherein:

The drawing is a simplified schematic flow diagram of an embodiment of the present invention.

Referring now to the drawing, a coal gasification or synthesis gas is withdrawn from a coal gasification zone, schematically generally indicated as 10, through line 11. Coal gasification zone includes a coal gasification reactor of a type known in the art in order to effect gasification of coal. The gas in line 11 generally contains carbon monoxide in an amount of from about 15% to about 50%, hydrogen in an amount from 30% to about 45%, and methane in an amount of from about 1% to about 18%, all by volume. The gas further includes carbon dioxide and gaseous sulphur compounds; in particular, hydrogen sulfide and carbon oxysulfide. The gas in line 11 is introduced into an acid gas absorption tower, schematically generally indicated as 12, which is provided with an acid gas absorption solution, such as diethanolanine or potassium carbonate, through line 13. As a result of the contact between the lean acid gas absorption solution, and the gas in tower 12, acid gases, in particular, carbon dioxide, and gaseous sulphur compounds, are absorbed by the absorption solution. The rich absorption solution is withdrawn from tower 12 through line 14 and introduced into an acid gas absorption solution regeneration zone, of the type generally known in the art, and schematically generally indicated as 15 in order to effect regeneration of the acid gas absorption solution by stripping acid gases therefrom.

Synthesis gas, which is essentially free of acid gases (the gas generally contains trace amounts of sulphur compounds) is withdrawn from tower 12 through line 16, combined with a recycle gas in line 17, obtained as hereinafter described, and the combined gas in line 18 introduced into reactor 19. Reactor 19 includes a reduced iron catalyst, which may or may not include a promoter, such as copper, potassium carbonate or sodium carbonate, and the reactor is operated at the conditions hereinabove described to effect conversion of carbon monoxide and hydrogen primarily to methane, and in addition produce small amounts of olefins, with carbon monoxide also being converted to carbon dioxide. The reactor 19 is a fluidized bed type of reactor, and includes suitable cooling tubes, schematically generally indicated as 21, which are provided with a heat transfer fluid in order to cool the fluidized bed and maintain the reactor at the desired temperature conditions. The cooling fluid is preferably DOWTHERM, and DOWTHERM vapor generated during the cooling, in line 22, may be employed for generation of high pressure steam. The reactor 19 is provided with catalyst makeup through line 23, and spent catalyst is withdrawn through line 24. As hereinabove noted, any trace amount of sulphur compounds present in the gas introduced into reactor 19 are removed therefrom by combining with the iron catalyst to produce ferrous sulfide. The catalyst makeup and withdrawal is effected through suitable lock hoppers.

A gaseous effluent, containing methane, small amounts of olefins, carbon monoxide, hydrogen and carbon dioxide generated as byproduct, as well as some amounts of water vapor, is withdrawn from reactor 19 through line 26 and cooled in heat exchangers 27 and 28 and cooler 29 prior to introduction into a gas-liquid separator, schematically generally indicated as 31, in order to separate any condensed liquid; i.e., water. Gas withdrawn from the vapor liquid separator 31 through line 32 is introduced into a carbon dioxide absorber, schematically generally indicated as 33, wherein the gas is contacted with a suitable carbon dioxide absorption solution, such as an alkali carbonate or an alcohol amine in order to effect removal of carbon dioxide from the gas. Rich absorption solution is withdrawn from tower 33 through line 34 and introduced into a regenerator, schematically generally indicated as 35, in order to effect regeneration of the carbon dioxide absorption solution by stripping carbon dioxide therefrom. The lean absorption solution is recycled to tower 33 through line 36.

Gas, which has been scrubbed of carbon dioxide, is withdrawn from tower 33 through line 37, and a first portion thereof in line 38 is combined with recycle in line 39, obtained as hereinafter described, and the combined stream passed through exchanger 27 to effect heating thereof. The heated stream in line 41 is then introduced into a methanation reactor, schematically generally indicated as 42.

The methanation reactor contains a plurality of spaced nickel catalyst beds, schematically generally indicated as 43, and such reactor is operated at the conditions hereinabove described in order to effect methanation of the carbon monoxide and hydrogen present in the gas introduced through line 41. In general, the gas introduced through line 41 contains from about 1% to about 3% of carbon monoxide, and from about 4% to about 11% of hydrogen, all by volume.

The exothermic heat of reaction in reactor 42 is controlled by introducing a quench gas between the beds. In particular, the remaining portion of the gas withdrawn from carbon dioxide absorber 33 through line 37, in line 44, is compressed by a compressor 45 and a first portion thereof passes through line 46 and expanded into reactor 42, between beds, through lines **46*a* and 46*b* to effect cooling within the methanation reactor 42**. In general, the temperature increase through the reactor is limited to the order of from about 150° F. to about 500° F. In the methanation reactor, in addition to the production of additional methane, olefins are converted to alkanes.

A methanation effluent is withdrawn from methanator 42 through line 51 and cooled in a waste heat boiler 52 to thereby generate steam and recover the heat content of the gas. The gas is then further cooled in a suitable cooler 53 and introduced into a gas liquid separator 54 in order to separate condensed liquids; namely, water. Gas is withdrawn from separator 54 through line 55 and a portion thereof passed through line 56, including a compressor 57, for recycle to the methanation reactor through line 39. The recycle gas is employed for the purpose of controlling the methanation temperature, and may also be employed for adjusting the carbon monoxide to hydrogen ratio in the methanator. The remaining portion of the gas is employed as a pipeline gas in line 58, and such pipeline gas generally has a heat content in the order of from about 1025 to about 1050 BTU per SCF.

A further portion of the compressed gas from carbon dioxide absorber 33 in line 61 is heated in heat exchanger 28 and recycled to reactor 19 through line 17. Such recycle gas is employed for the purpose of preheating the feed to the reactor and for the further purpose of adjusting the carbon monoxide to hydrogen ratio in the feed to reactor 19.

The present invention is particularly advantageous in that it enables production of a pipeline gas having a higher heat content than that which was heretofore produced from coal gasification. The additional heat content is provided by the presence of alkanes in the pipeline gas. Moreover, it it possible to produce such an improved pipeline gas without the necessity of elaborate sulphur removal steps prior to the methanation stages. Furthermore, the process is more economical by eliminating the carbon monoxide shift reacting system. In addition, heat of reaction is effectively recovered for generating process steam. These and other advantages should be apparent to those skilled in the art from the teachings herein.

Numerous modifications and variations of the present invention are possible in light of the above teachings and, therefore, within the scope of the appended claims, the invention may be practised otherwise than as particularly described.

I claim:

1. In a process for producing pipeline gas from coal by effecting gasification thereof to a gas containing carbon monoxide, hydrogen, gaseous sulphur compounds and carbon dioxide, the improvement comprising:

(a) contacting said gas with an acid gas absorption solution to separate gaseous sulphur compounds and carbon dioxide therefrom;

(b) contacting said gas with a reduced iron catalyst at a temperature of from about 375° to about 550° C. and at a pressure of from about 20 to about 100 atm to produce methane, carbon dioxide and some olefins;

(c) separating carbon dioxide from the gas produced in step (b);

(d) contacting gas obtained from step (c) with a nickel catalyst at a temperature of from about 230° C. to about 600° C. and a pressure of from about 10 atm to about 70 atm to produce additional methane and convert olefins to alkanes; and (e) employing gas from step (d) as a pipeline gas.

2. The process of claim 1 wherein said pipeline gas has a heating value of at least 1000 BTU per SCF.

3. The process of claim 2 wherein the gas from step (a) contains less than 3–5 ppm of sulfur.

4. The process of claim 3 wherein said catalyst of step (b) is maintained as a fluidized bed.

5. The process of claim 4 wherein step (b) is effected with a hydrogen to carbon monoxide mole ratio of from 0.8:1 to 2.5:1.

6. The process of claim 5 wherein the temperature rise in the contacting of step (d) is from 150° F. to 500° F.

7. The process of claim 6 wherein said temperature rise in step (d) is controlled by the use of a quench gas in step (d).

8. The process of claim 7 wherein the quench gas is a portion of the gas obtained in step (c) which is compressed and expanded to effect quench cooling in step (d).

9. The process of claim 6 wherein the gas employed in step (d) contains 1% to 3% of carbon monoxide and 4% to 11% of hydrogen, by volume.

10. The process of claim 9 wherein step (d) is effected at a temperature of from 425° to 475° C. and a pressure of from 30 to 75 atms.

11. The process of claim 10 wherein step (d) is effected at a temperature of from 260° to 480° C.

12. The process of claim 11 wherein a portion of the gas obtained in step (c) is recycled to step (b) to adjust the carbon monoxide to hydrogen ratio in step (b).

13. The process of claim 2 wherein the said gas contains from 15% to 50% carbon monoxide and from 30% to 40% of hydrogen, by volume.

14. The process of claim 2 wherein step (b) is effected with a hydrogen to carbon monoxide mole ratio of from 0.9:1 to 1.8:1.

15. The process of claim 5 wherein the heating value of the pipeline gas is from 1025–1100 BTU per SCF.

* * * * *